United States Patent [19]

Cimenti et al.

[11] Patent Number: 4,941,792

[45] Date of Patent: Jul. 17, 1990

[54] HANDLING DEVICE FOR A DISTRIBUTION CHUTE OF A SHAFT FURNACE AND DRIVE MECHANISM SUITABLE FOR THIS DEVICE

[75] Inventors: Giovanni Cimenti, Fentange; Emile Lonardi, Bascharage; Pierre Mailliet, Howald, all of Luxembourg

[73] Assignee: Paul Wurth S.A., Luxembourg

[21] Appl. No.: 382,517

[22] Filed: Jul. 19, 1989

[30] Foreign Application Priority Data

Jul. 25, 1988 [LU] Luxembourg ..... 87291
Nov. 9, 1988 [LU] Luxembourg ..... 87380

[51] Int. Cl.[5] ..... F23K 3/18

[52] U.S. Cl. ..... 414/208; 414/299; 414/302; 239/659; 239/687; 266/199

[58] Field of Search ..... 414/150, 152, 153, 160, 414/170, 172, 179, 193, 195, 196, 204, 205, 208, 287, 299, 300, 301, 302, 206, 207; 239/659, 687, 681; 266/197, 199; 432/96, 98

[56] References Cited

U.S. PATENT DOCUMENTS

| | | | |
|---|---|---|---|
| 3,682,394 | 8/1972 | Shivvers | 414/301 X |
| 3,851,927 | 12/1974 | Weichel | 414/301 X |
| 3,880,302 | 4/1975 | Legille | 414/206 |
| 4,094,494 | 6/1978 | Mahr | 414/160 X |
| 4,243,351 | 1/1981 | Legille et al. | 414/206 |
| 4,273,492 | 6/1981 | Legille et al. | 414/206 |
| 4,360,305 | 11/1982 | Dorsch | 414/208 |
| 4,368,813 | 1/1983 | Mailliet | 414/160 X |
| 4,419,036 | 12/1983 | Beckenbach et al. | 414/160 |
| 4,547,116 | 10/1985 | Legille et al. | 414/160 |
| 4,729,549 | 3/1988 | Lonardi et al. | 414/207 X |

FOREIGN PATENT DOCUMENTS

| | | | |
|---|---|---|---|
| 0038409 | 4/1981 | Japan | 266/199 |
| 0087613 | 7/1981 | Japan | 266/199 |
| 2218506 | 9/1987 | Japan | 414/195 |

*Primary Examiner*—Robert J. Spar
*Assistant Examiner*—John VandenBosche
*Attorney, Agent, or Firm*—Fishman, Dionne & Cantor

[57] ABSTRACT

The present invention relates to a handling device for a distribution chute of a shaft furnace, the said distribution chute being suspended pivotably on a rotary cage mounted by means of bearings in a housing installed in the head of the furnace and containing drive means for rotating the said cage about the vertical axis of the furnace and drive means for pivoting the chute about its horizontal suspension axis. The invention also relates to a mechanism for driving the chute which is suitable for this device.

7 Claims, 3 Drawing Sheets

HANDLING DEVICE FOR A DISTRIBUTION CHUTE OF A SHAFT FURNACE AND DRIVE MECHANISM SUITABLE FOR THIS DEVICE

TECHNICAL FIELD

This invention relates to devices for charging shaft furnaces.

BACKGROUND

U.S. Pat. No. 3,880,302 the disclosure of which is incorporated herein by reference, describes a mechanism for the suspension and driving of a distribution chute of a charging installation of a shaft furnace. This mechanism has proved especially effective and advantageous, and since its creation it has equipped many charging installations of blast furnaces.

The replacement of the distribution chute, the inner lining of which has to be renewed regularly, can be carried out by means of a handling device of the type described in U.S. Pat. No. 4,729,549, the disclosure of which is incorporated herein by reference. According to this patent, the chute is extracted laterally through an orifice made in the upper conical part of the wall of the furnace. This does not present any problem, particularly as regards the new high-capacity furnaces which can be designed according to the particular type of charging installation. However, some problems can arise in the modernization of existing furnaces, especially blast furnaces of relatively low capacity in which the charging installation and the work platform are supported directly by the wall of the furnace. In this case, in fact, it is not possible to make an orifice in the furnace wall and in the work platform, to avoid reducing their stability and resistance, unless they have previously been reinforced by means of considerable and costly conversions.

SUMMARY OF THE INVENTION

The object of the present invention is to provide a new handling device for a chute, which is especially suitable for the replacement of a chute in this type of blast furnace.

An additional object of the invention is a mechanism for driving the chute, which is as simple as possible and which does not impede the replacement of the chute.

To achieve this object, the handling device of the present invention has inner and outer housings which possess removable parts for allowing the chute to pass through for the purpose of mounting or dismounting the chute. A ramp is mounted on a platform surrounding the head of the furnace and supported by the latter. The ramp has a carriage which can slide along the said ramp and which is equipped with means for fastening it to the chute.

Because the distribution chute is disengageable via its drive and suspension mechanism, it is no longer necessary to weaken the wall of the furnace by an orifice for the extraction of the chute.

The carriage sliding along the ramp is preferably mounted on track rollers and is fastened to a chain or a hauling cable travelling round guide pulleys at the ends of the ramp under the action of a drive motor.

The means for fastening the chute to the carriage can consist of a sliding hammer-head rod which can be engaged by sliding and rotation in the upper rim of the chute.

The invention also provides a mechanism for driving a chute which is suitable for the above-described device and which comprises a first and second rolling ring designed respectively for rotating the chute about the vertical axis of the furnace and modifying its angle of inclination in relation to this axis as a result of pivoting about its horizontal suspension axle, and means for actuating the two rolling rings independently of one another, the first embodiment of which is characterized in that the second rolling ring is connected by means of an articulated linkage to two arms fastened on either side of the chute on the suspension axle of the latter.

This linkage preferably consists of a forked element, the teeth of which are articulated on the ends of the said arms and the opposite end of which is articulated on a pivoting lever mounted on the rotary housing, so as to be capable of tilting in the same direction of the chute, and the free end of which is connected to the second rolling ring by means of a link.

According to a second embodiment, the drive mechanism provided by the invention is characterized by a toothed quadrant fixed to one of the suspension axles of the chute and forming a bevelled gear with a toothed section of the second rolling ring.

BRIEF DESCRIPTION OF THE DRAWINGS

Other particular features and characteristics will emerge from the description of some preferred embodiments given below as an illustration, with reference to the accompanying drawings in which.

DETAILED DESCRIPTION OF THE INVENTION

Figure 1:
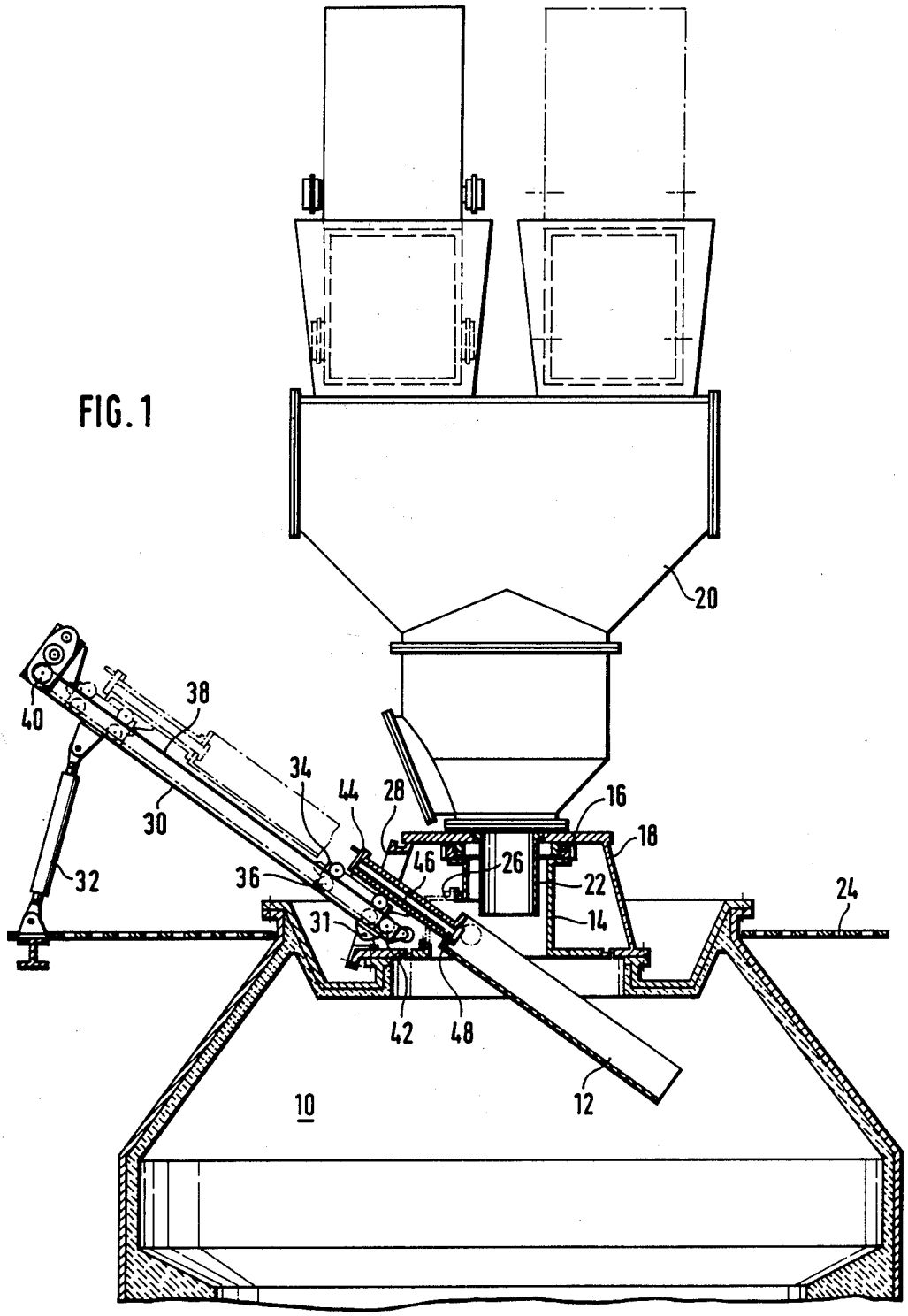
FIG. 1 shows a diagrammatic view in vertical section of a device for handling a chute according to the present invention.

The accompanying FIG. 1 shows the head of a blast furnace 10 equipped with a charging installation comprising a rotary and pivoting distribution chute 12 which is suspended on a drive mechanism of which two advantageous embodiments will be described below. The blast furnace 10 is a furnace initially equipped with a conventional bell-type charging installation which has been replaced by the charging device illustrated in FIG. 1. The chute 12 is suspended pivotably on an inner housing 14 which is itself suspended, by means of a bearing 16, in a stationary housing fixed to the wall of the furnace 10. The housing 18 contains mechanisms for rotating the inner housing 14 about the vertical axis of the furnace and for adjusting the angle of inclination of the chute 12. These drive mechanisms will be described in more detail below.

The charging material, which undergoes intermediate storage in a lock chamber 20, falls axially onto the chute 12 via a central tube 22.

It should be noted that the entire charging installation, including the lock chamber 20 and the mechanism for the driving and suspension of the chute, and a circular work platform 24 arranged round the head of the furnace 10 are supported by the wall of the latter. This is why an orifice for the extraction of the chute 12 cannot be made in the furnace wall, to avoid weakening it, unless considerable modifications to the framework are carried out. It nevertheless remains necessary to provide the possibility of dismounting the chute 12, because this has to be replaced from time to time.

For this purpose, the present invention proposes that the chute 12 is mounted and dismounted via its drive and suspension mechanism. As shown in FIG. 1, the inner housing 14 possesses a removable cover 26 which is sufficiently large to allow the chute 12 to pass through. This cover 26 is in the oblique extension of a lateral orifice 28 allowing access to the housing 18. This orifice 28 is present, in any event, for the maintenance of the drive mechanism of the chute 12. Depending on the construction, it may be necessary also to make lateral orifices in the housing, in order to detach the chute from its suspension axle.

To allow the chute 12 to be extracted and introduced via the removed cover 26 and the orifice 28, there is a ramp 30 fastened to a pivot 31 on the lower edge of the orifice 28. A support 32, if appropriate telescopic to allow the angle of inclination of the ramp 30 to be changed, is mounted on the platform 24 and supports the ramp 30 in the inclined position as shown in FIG. 1. This ramp 30 is preferably designed to be taken away after use by the lifting means located on the spot and/or to be stowed in a suitable place. However, depending on the design of the furnace, and if it does not obstruct the platform 24, it can remain in place, after being turned down horizontally and withdrawn rearwards by means of its support 32 which, for this purpose, can be actuated by means of a hydraulic jack.

Located on the ramp 30 is a carriage 34 which can slide along the ramp 30 on track rollers 36. Carriage 34 can be obtained by means of a chain or a hauling cable 38, the ends of which are fastened to the carriage 34 and which travel round an upper guide pulley 40 and a lower guide pulley 42. The cable 38 can be driven by means of a motor acting on one of the pulleys 40 or 42.

A device 44 for fastening the chute 12 is located on the sliding carriage 34. This fastening device 44 can be formed in various ways. FIG. 1 shows, by way of illustration, a rod 46 sliding in a sleeve and having a hammer-shaped head which can be passed through a slot in the upper rim 48 of the chute 12 and which can be retained behind the latter after a quarter-turn rotation of the rod 46. It is then sufficient to secure the rod 46 in its sleeve in order to fasten the chute 12 and which can be retained behind the latter after a quarter-turn rotation of the rod 46. It is then sufficient to secure the rod 46 in its sleeve in order to fasten the chute 12 to the device 44 and to the carriage 34. The extraction of the chute 12 can thereafer be carried out by shifting the carriage 34 from the position represented by broken lines. In this position, the chute 12 can be attached to lifting systems provided round the furnace, before being released from the carriage 34.

Although the mechanism for driving the chute, known from the document No. DE-C2-2,324,970, could, if need be, be used with the above-described system for dismounting the chute, if appropriate after some conversions, it is nevertheless not the ideal solution for this. First of all, the drive housing is to some extent obstructed by the gears, and it is difficult to find the room necessary for extracting the chute through this housing. Furthermore, because of its complexity, this mechanism is less viable for furnaces of small size. Another problem arises because the charging installation is supported by the wall of the furnace, this being the case in the particular example to which the present invention relates. In fact, it is well known that the wall of the furnace undergoes thermal expansion movements and these therefore have an effect on the housing of the mechanism from driving the chute, this mechanism consequently being exposed to risks of deformation. Now the known drive mechanisms comprising a complex system of gears and pinions, particularly in the region of the two rotary boxes causing the pivoting of the chute, do not tolerate deformations of this extent.

In this respect, the two embodiments of a drive mechanism which are given below are better suited to this type of charging installation equipped with a chute replacement system, such as that described above. In the first embodiment of FIGS. 2 and 3, the housing 18 contains two rolling rings 50 and 52, the peripheral gears of which are actuated respectively by two pinions (not shown) which are driven independently of one another by means which, for example, can be those of the known mechanism of the above-mentioned document. The first rolling ring 50 is fixed to a rotary housing 54, inside which the chute 12 is suspended pivotably by means of bearings. This suspension can, for example, be of the type described in Luxembourg Patent Application No. 87,341 designed to make it easier to dismount the chute.

The second rolling ring 52 is connected to the suspension axles of the chute 12 by means of a linkage, in order to ensure its angular adjustment in relation to the vertical axis. For this purpose, the suspension axle of the chute 12 is fixed, on either side of the rotary housing 54, to two arms 56, 58. The ends of these two arms 56, 58 are articulated on the two ends of a forked element 60, the opposite end of which is connected to a lever 62 mounted pivotably on a peripheral horizontal sill 64 of the rotary housing 54. The upper end of this pivoting lever is connected to the rolling ring 52 by means of link 66.

For reasons of stability, the pivoting lever 62 is preferably designed in the form of a U (see FIG. 3), the base of which is mounted on the sill 64 by means of a bearing or a hinge. The end of the element 60 is connected to the two lateral branches of the lever 62 by means of a crossmember 68. All the connections of the linkage are articulated in order to allow it to experience deformation.

It should be noted that the element 60 could be actuated directly by the link 66, but to ensure a better distribution of the force components it is preferable for the pivoting lever 62 to be present.

When the two rolling rings 50, 52 are actuated synchronously, the chute 12 rotates together with the rotary housing 54 about the vertical axis O at a constant angle of inclination in relation to this axis. In contrast, when the ring 52 experiences a relative movement in relation to the rolling ring 50, for example as a result of acceleration, it modifies the angular position of the chute 12 in relation to the vertical axis O by means of the deformation of the linkage. When this linkage is deformed from the configuration represented by thick lines towards the configuration represented by thin lines, the chute 12 is tilted from the angular position represented by unbroken lines in FIG. 2 into the vertical position represented by broken lines. FIG. 3 shows that the angle of the relative movement of the ring 52 in relation to the ring 50 necessary for the pivoting of the chute 12 is very small.

Figure 2:
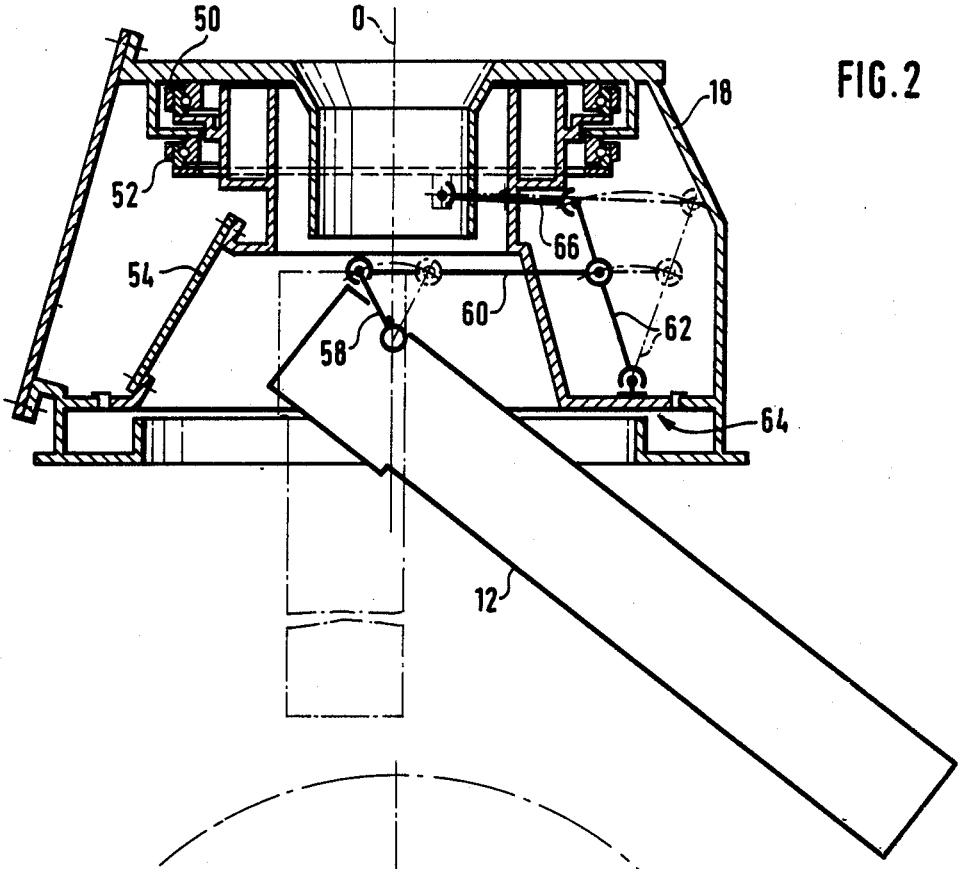
FIGS. 2 and 3 respectively show diagrammtically a view in vertical section and a plan view of the first embodiment of a drive mechanism for a distribution chute.
Figure 3:
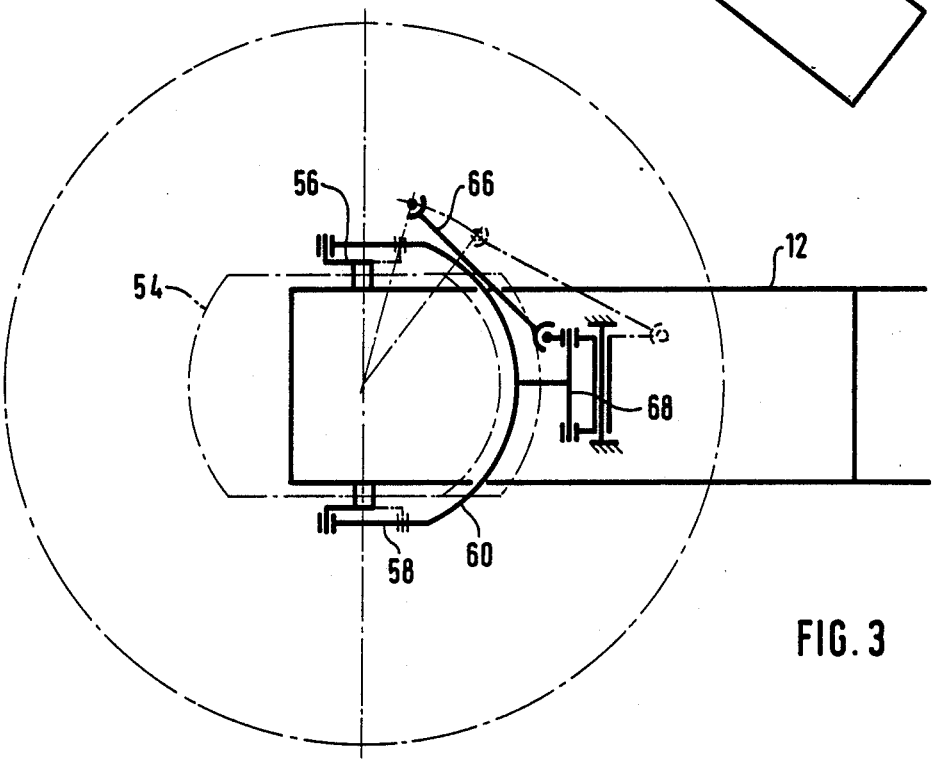

In comparison with gear transmissions, the transmission by means of the linkage shown in FIGS. 2 and 3 has the advantage of tolerating slight deformations of the wall of the housing 18. Moreover, the linkage is arranged completely on the opposite side to that on which the chute is extracted from the housing 18 according to the method proposed in FIG. 1, so that it does not impede the replacement of the chute.

Figure 4:
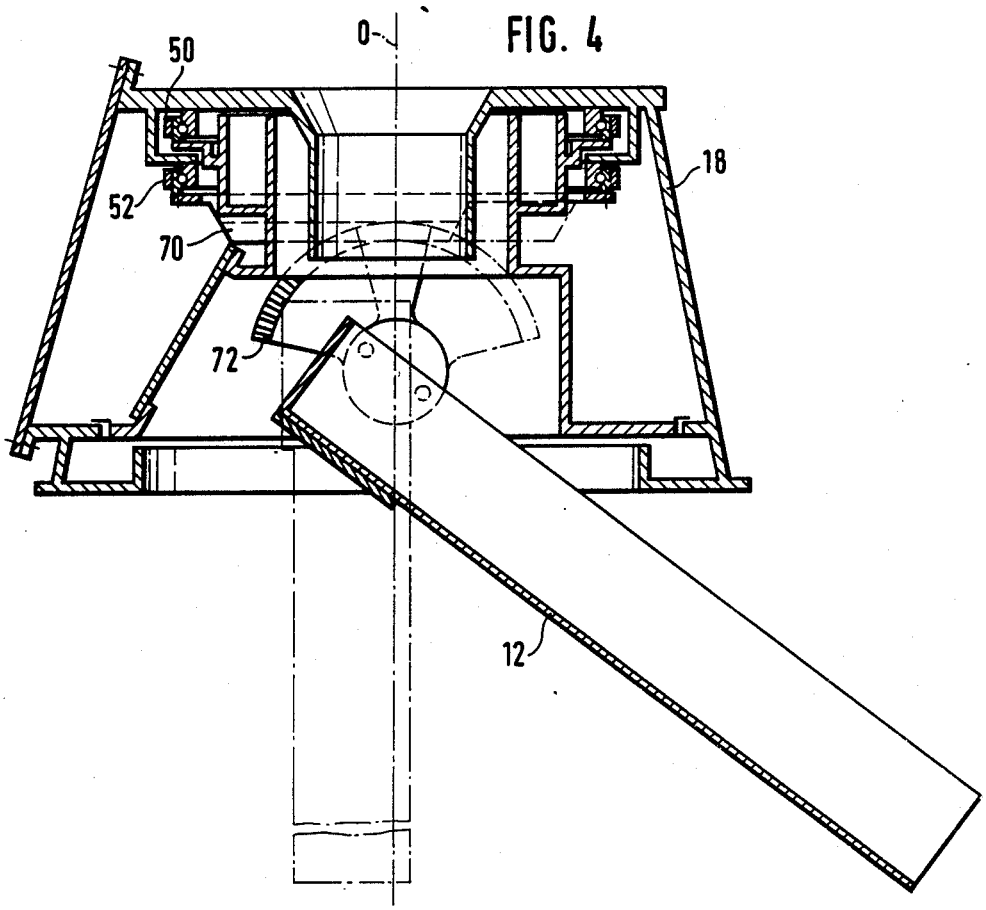
FIGS. 4 and 5 respectively show diagrammtically views in vertical section of a second embodiment of a drive mechanism for a distribution chute.
Figure 5:
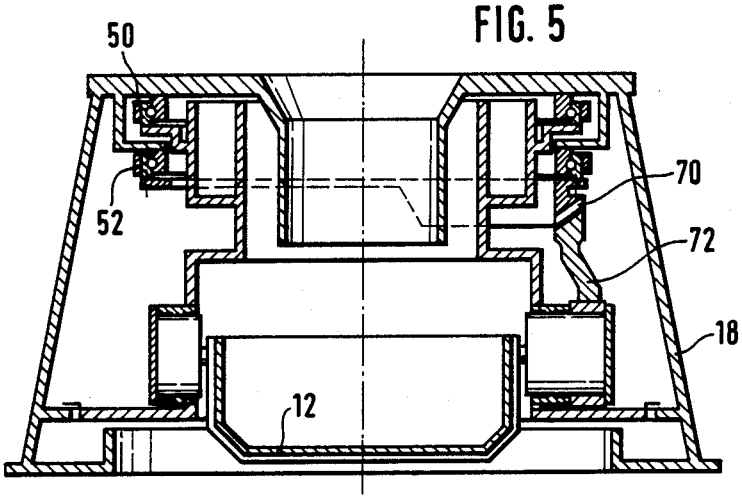

The embodiment according to FIGS. 4 and 5 also has two rolling rings 50 and 52 identical to those of the preceding embodiment. In this embodiment, the toothed ring 54 carries, in addition to its peripheral gear, a toothed section 70 which forms a bevelled gear with a toothed quadrant 72 fixed to one of the suspension axles of the chute 12. Consequently, a relative movement of the rolling ring 52 in relation to the ring 50 gives rise, as a result of the action of this bevelled gear 70, 72, to a pivoting of the chute 12 in relation to the vertical axis O. This system for driving the chute is arranged on the lateral side of the latter, so that it does not obstruct the side on which the chute is dismounted according to FIG. 1.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. An apparatus for charging a shaft furnace, comprising:

a platform adapted for mounting on the shaft furnace;
an outer housing rigidly attached to the platform;
an inner housing rotatably mounted within the outer housing, said inner housing having an axis of rotation;
a distribution chute pivotably suspended from the inner housing;
means for rotating the inner housing about the axis;
means for pivoting the chute relative to the axis; and
means for dismounting the chute, comprising:
an inclined ramp mounted on the platform;
a carriage slidably mounted on the ramp;
means for accessing the chute; and
means for fastening the carriage to the chute.

2. The apparatus of claim 1, wherein:

the ramp has a top end and a bottom end;
the carriage rides on track rollers; and
the apparatus further comprises:
guide pulleys mounted at the ends of the ramp;
a cable attached to the carriage and travelling around the guide pulleys; and
means for driving the cable.

3. The apparatus of claim 1, wherein:

the chute has a top end and a bottom end; and
the means for fastening the chute to the carriage comprises a sliding hammer head rod which engages the top end of the chute.

4. The apparatus of claim 1, wherein:

the chute pivots about a horizontal suspension axle;
the means for driving the inner housing comprises a first rolling ring between the inner housing and the outer housing; and
the means for driving the chute comprises:
a second rolling ring;
a pair of arms extending from the suspension axle of the chute; and
an articulated linkage connecting the second rolling ring to the arms.

5. The apparatus of claim 4, further comprising a pivoting lever mounted on the inner housing, the lever having a first end and a second end; and an articulated link between the second end of the pivoting lever and the second ceiling ring; and wherein:

the articulated linkage comprises a forked element, the forked element having a base and two tines, the base being articulated with the first end of the pivoting lever, each of the tines is articulated with one of the arms.

6. The apparatus of claim 4, further comprising:

a pivoting lever mounted on the inner housing, said lever having a base and two branches; and
a cross member extending between the two branches;
wherein the articulated linkage comprises a forked element, the forked element having a base and two tines, the base being connected with the cross member, and each of the tines being articulated with one of the arms.

7. The apparatus of claim 4, further comprising:

a toothed quadrant mounted on the suspension axle of the chute; and
a toothed section on the second rolling ring, said toothed section articulating with the toothed quadrant.

* * * * *